United States Patent [19]

Gill et al.

[11] Patent Number: 4,538,598

[45] Date of Patent: Sep. 3, 1985

[54] THERAPEUTIC TRACTION DEVICE

[76] Inventors: Gerald G. Gill, 320 Upper Ter., San Francisco, Calif. 94117; Donald G. Rhodes, 2747-21st St., San Pable, Calif. 94806

[21] Appl. No.: 418,848

[22] Filed: Sep. 16, 1982

Related U.S. Application Data

[63] Continuation of Ser. No. 177,382, Aug. 12, 1982, abandoned.

[51] Int. Cl.[3] ..... A61H 1/02

[52] U.S. Cl. ..... 128/75; 128/84 C

[58] Field of Search ..... 128/69–71, 128/75, 84 C; 272/134, 135, 140, 132, 133

[56] References Cited

U.S. PATENT DOCUMENTS

| | | | |
|---|---|---|---|
| 2,282,653 | 5/1942 | Herzmark | 128/84 C |
| 2,959,414 | 11/1960 | Saltz | 272/140 |
| 3,298,364 | 1/1967 | Radford | 128/75 |
| 3,709,217 | 1/1973 | Powers | 128/75 |
| 3,752,475 | 8/1973 | Ott | 272/140 |
| 3,826,490 | 7/1974 | Mossman | 272/134 |
| 3,851,874 | 12/1974 | Wilkin | 272/136 |

OTHER PUBLICATIONS

"A Traction Device", *American Journal of Bone & Joint Surgery;* vol. 45A.

*Primary Examiner*—Richard J. Apley
*Assistant Examiner*—David J. Brown
*Attorney, Agent, or Firm*—Bielen and Peterson

[57] ABSTRACT

A therapeutic traction device for applying traction to a human body wearing a traction sling comprising a spring loaded pulley having a grooved rim rotatably attached to an upright support member and including a cord that is wound in the groove of said pulley, with one end extending out therefrom and attached to said traction sling. The spring loading provides the tension force desired for the particular type of traction being performed. The device is also portable and includes a base member, rigidly attached to the support member, having a shape adapted to extend into and rest between a bed frame and mattress.

14 Claims, 3 Drawing Figures

THERAPEUTIC TRACTION DEVICE

This is a continuation of application Ser. No. 177,382 filed Aug. 12, 1982, now abandoned.

This invention relates in general to therapeutic traction devices, and more specifically to such a device using a spring loaded pulley for generating a tension force, a cord wound around the pulley for coupling this force to a patient, and means for affixing the device to a bed or the like in a simple manner.

Preferably, the present invention is directed to the treatment of cervical spine injuries or diseases. Discogenic disease of the cervical spine is a common condition and often leads to chronic disability, pain, and discomfort in the arms and in the neck, as well as causing headaches. In addition, the occurrence of acceleration injuries to the neck such as those which occur following rear end collisions are of increasing importance. The treatment of these neck conditions in the past has included the use of heat, or sometimes cold, the use of a collar or a support, massage, and sometimes ultrasound diathermic treatment. None of these measures have proven to be of extreme advantage.

Cervical traction has also been used in the past, with the most common type of traction being the use of alternating traction or motorized traction. Since such treatment involves the use of relatively complex equipment, the patient is usually required to travel to a physical therapy unit, thereby perhaps negating the benefit of the therapy.

Various types of traction have been used in the home, but such devices have usually consisted of over-door traction devices having pulleys and weights, by which traction is applied to the head of a patient wearing a traction sling, with the patient in a sitting position. In this position, however, the disadvantage is that the weight of the head is probably about equal to the amount of traction pull obtained, thereby substantially negating the influence of the traction.

Reclining traction devices are also known in the prior art. However, these prior art devices have generally had the drawback of being complex and of considerable bulk and weight. Such prior art therapeutic traction devices have also required a specific bed or platform to which the device must be rigidly secured by means of bolts or the like. This system is disadvantageous where such special beds are not available, or would be too expensive, such as in the home. A therapeutic traction device of simple construction, designed to be portable and designed to be useable on any bed, would resolve the above identified deficiencies of the prior art.

U.S. Pat. No. 3,298,364 to J. C. Radford, discloses one attempt to design a relatively non-bulky traction device that is also portable. However, there were two difficulties with this device besides the drawback that weights were required in the operation of this device. The major one was that the cords used in this device, to attach both the traction sling and a weight to the device, were required to be wrapped in a peculiar way about a torsion bar. These cords tended to slip off the torsion bar, making this unit inoperable. Another problem with this prior art device was that the bolts which set the height of the traction bar were of such a design that the traction bar had a tendency to move and flex when traction was applied, negating the effectiveness of the apparatus.

Therefore, an object of the present invention is to provide a simple apparatus wherein the cord used to attach the apparatus to a traction sling will not slip out of its designed alignment with respect to the apparatus.

Another object of the present invention is to provide a lightweight traction device designed to be securable in a fixed position with respect to a patient without the requirement that the device be bolted to a bed or other platform.

A further object of the present invention is to eliminate the need for weights and the need for space behind a bed or the like for such weights to hang.

Yet another object of the present invention is to provide a portable therapeutic traction device that is easily assembled and disassembled.

Yet another object of the present invention is to provide a therapeutic traction device useable for other injuries requiring traction, such as pelvic traction.

These and other objects of the present invention will become more apparent upon reference to the following description and accompanying drawings in which.

DESCRIPTION OF THE PREFERRED EMBODIMENTS

Broadly stated, the present invention is a therapeutic traction device for use on a bed or the like including upright support means, means for affixing the support means with respect to the bed or the like, and a spring loaded pulley rotatably attached to the upright support means. The pulley has a grooved rim with a cord wrapped therein, with one end of said cord extending from the pulley and attached to a traction sling or the like worn by a patient.

Figure 1:
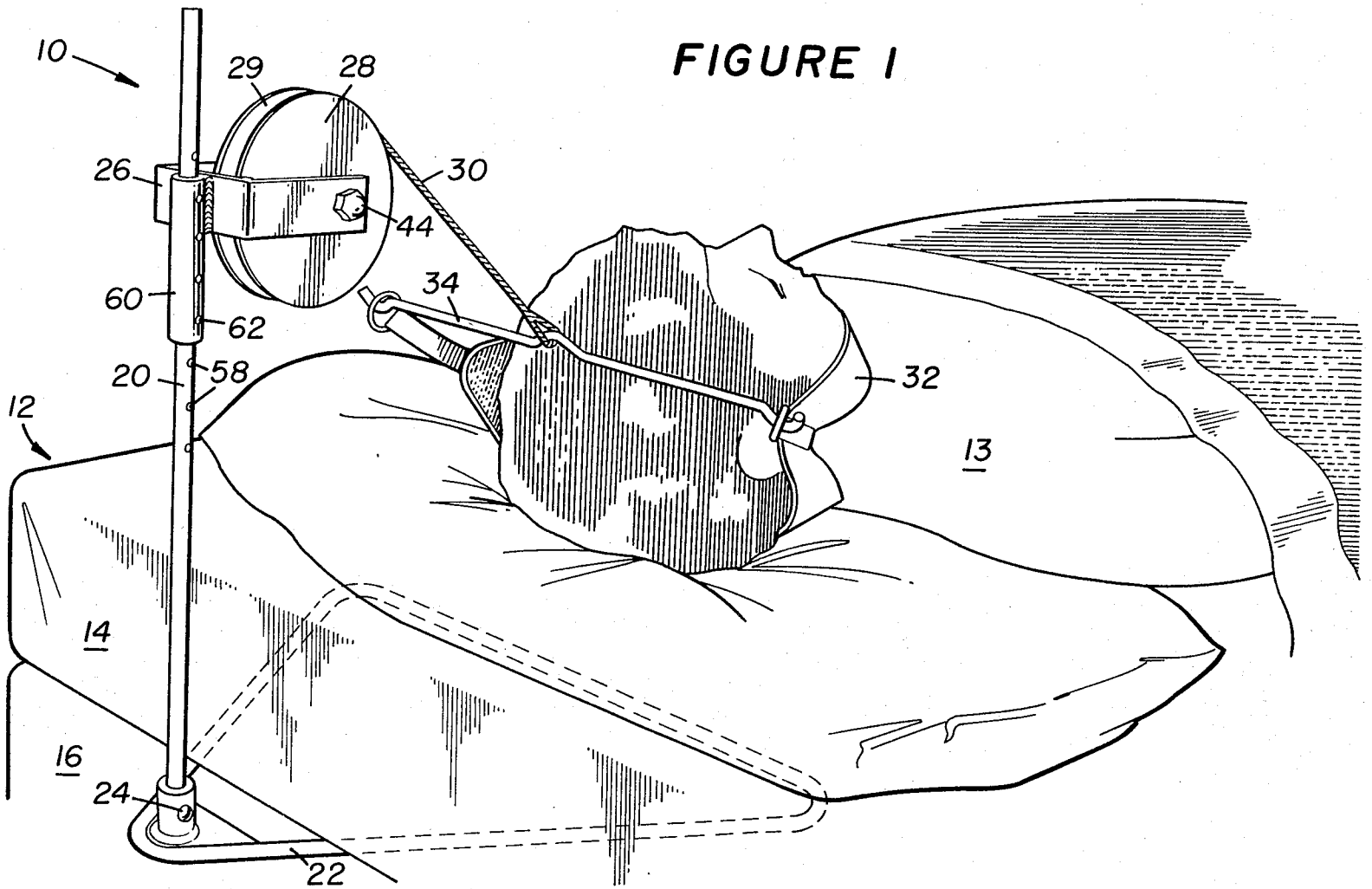
FIG. 1 is a side elevation view of a therapeutic traction device according to the present invention installed on a bed or the like and attached to a traction sling.

The therapeutic traction device according to the present invention is illustrated at 10 in FIG. 1 as being fixed or attached to a bed or other platform 12 on which the patient 13 needing traction treatment is reclining. Preferably, the traction device according to the present invention is installed on a bed between a mattress 14 and the bed frame or box springs 16.

The traction device 10 according to the present invention includes an upright support means comprising an elongated upright support member 20. The support member 20 is attached to the bed 12 by means of a base 22. Base 22 is shaped to fit between the frame 16 and mattress 14 to provide support for the upright support member 20. The upright support member 20 is rigidly attached to one end of the base member 22 in a manner to ensure rigid association between base member 22 and upright support member 20, while preferably doing so in such a way so as to enable disassembly thereof as desired, e.g., by using a set screw 24 or the like.

In the preferred embodiment, as seen in FIG. 1, the base member 22 is defined in the shape of a triangle, with the triangle oriented in a plane perpendicular to the upright support member 20, so that when the base member 22 is positioned between the mattress 14 and frame 16 of the bed, the upright support member 20 is in a vertical orientation with respect to the bed 12.

Releasably attached to the upright support member 20 is a U-shaped member 26 on which a pulley 28 is mounted. Attached at one end to said pulley 28 and wrapped around the pulley in a groove 29 formed on the rim of said pulley is a cord 30. The other end of the cord 30 may be attached to a patient 13 in a conventional manner, as with a traction sling 32 or the like. Note that a spreader bar 34 may be also used to operatively connect the cord 30 to the traction sling 32, with a bend in the spreader bar 34 at its center to hold the tied end of cord 30 in a fixed position with respect thereto.

Figure 2:
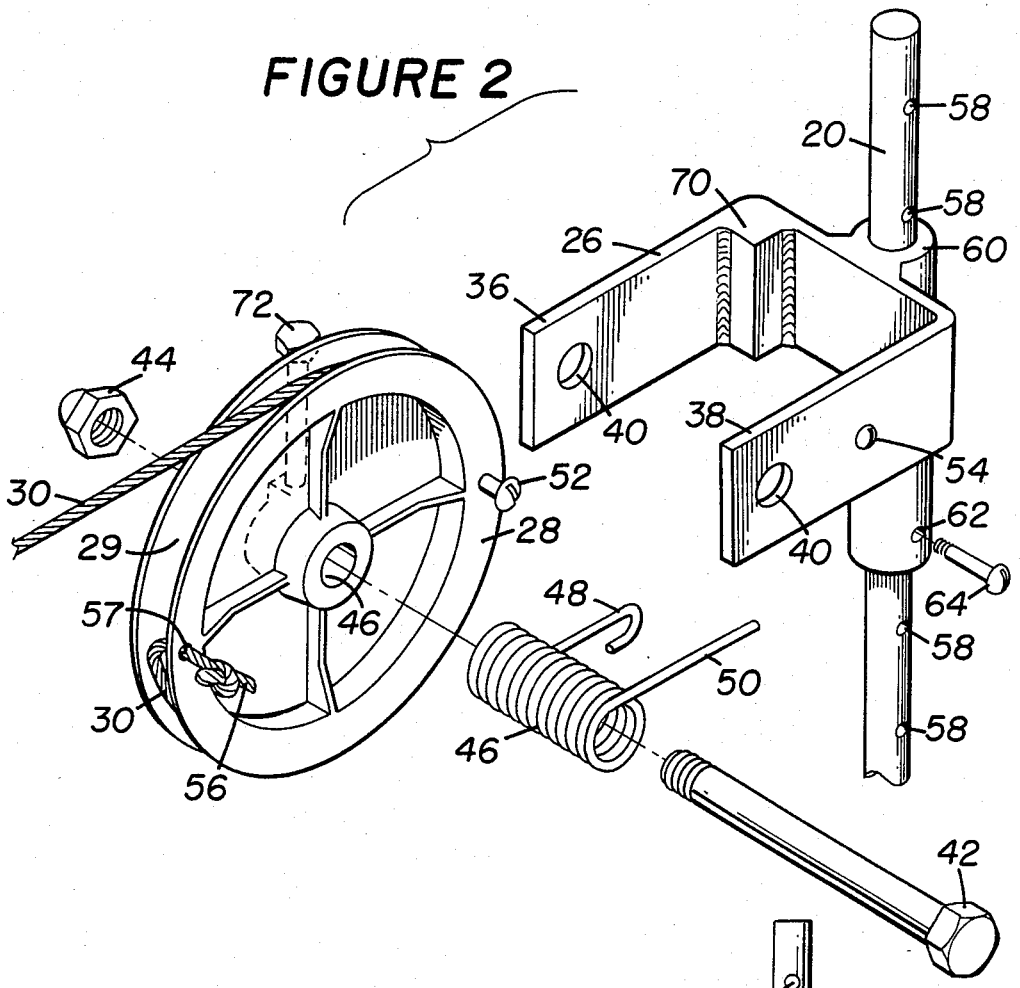
FIG. 2 is an enlarged exploded perspective view of the pulley assembly according to the present invention.

Referring now to FIG. 2, shown is an enlarged exploded perspective view of the pulley assembly according to the present invention. As seen in FIG. 2, the U-shaped member 26 includes two arms 36 and 38 which are positioned to extend towards the patient when he is reclining on the bed or the like on which the upright support bar 20 is secured. Each arm, 36, 38 includes an axle hole 40 through which an axle 42 is positioned. The axle 42 is securably retained in axle holes 40 in a conventional manner, e.g., by means of a nut 44 threadably attached to one end of axle 42. The pulley 28 includes a centrally defined axle hole 46, said pulley is mounted thereby on axle 42 between arms 36 and 38 of said U-shaped member 26. Rotation of pulley 28 with respect to the U-shaped member 26 is thereby enabled.

Pulley 28 is spring loaded by means of a spring, such as a wire wound coil, and is illustrated at 46. The coil spring 46 is operatively fastened with respect to the pulley 28 to provide spring loading of said pulley as said pulley is rotated. In the preferred embodiment, one end 48 of coil 46 is attached to pulley 28, while the other end 50 is attached to the U-shaped member 26. Attachment of end 48 to pulley 28 is preferably obtained by means of a screw 52 which is threadably fastened thereto. Attachment of end 50 to pulley 28 is preferably obtained by means of a screw 54 and a nut 55, shown in FIG. 3. Screw 54 is mounted through a hole defined in the U-shaped member 26. The coil 46 may be positioned with respect to pulley 28 by sizing the central core of the coil 46 so that axle 42 may extend therethrough. In such an arrangement, coil spring 46 would also act as a spacer for pulley 28 between the arms 36, 38 of U-shaped member 26.

As also seen in FIG. 2, the cord 30 is wound around pulley 28, with one end thereof, end 56, attached to pulley 28 in a conventional manner. A simple fastening means would be to feed the cord 30 through a hole 57 defined in the side of pulley 28, and knot the end 56 of cord 30 on the outside of the groove 29.

As mentioned above, U-shaped member 26 is releasably affixed to upright support member 20. This is to enable ease in the assembly and disassembly of the therapeutic traction device according to the present invention. The angle of traction pull generated by the therapeutic traction device is also adjustable thereby. In the preferred embodiment, as seen in FIG. 2, transverse holes 58 are drilled in the upright support member 20. In the preferred embodiment, upright support member 20 is an elongated rod. The U-shaped member 26 includes a cylindrical portion 60 of a size to enable the upright support member 20 to extend therethrough. Cylindrical portion 60 includes at least one hole 62 drilled therethrough of such size and shape such that a removable rivet 64 may be inserted through hole 62, and lined up with a respective hole 58, inserted through that hole also and out the other side of the cylindrical portion 60. Rivet 64 would thereby secure the U-shaped member 26 at a specific height on said upright support member 20.

Figure 3:
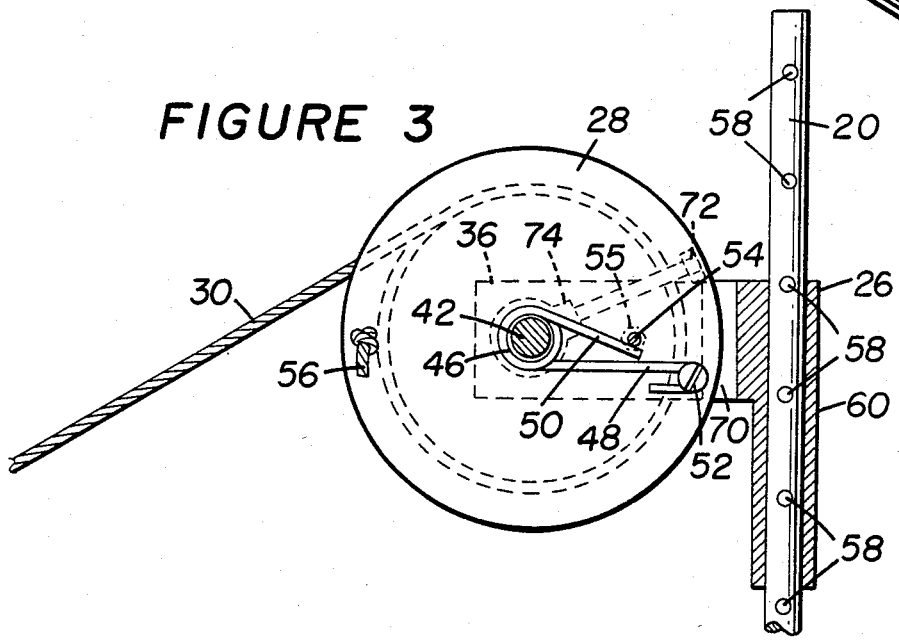
FIG. 3 is an enlarged partially broken away side view of the pulley assembly according to the present invention.

Means are also provided for presetting the level of tension applied to said pulley 28 by means of coil spring 46, and thereby for presetting the traction force. This means includes means for preventing the rotation of pulley 28 beyond a predetermined angle. As seen in FIGS. 2 and 3, in the preferred embodiment said means comprises a stop flange 70 formed on said U-shaped member 26, and a correspondingly positioned projecting member, comprising an elongated bolt 72 attached to pulley 28. Bolt 72 is positioned such that it contacts stop 70 before one complete revolution of pulley 28 can occur. Bolt 72 may be attached to pulley 28 in a conventional manner, as by threadably securing bolt 72 into a hole defined in projection 74 formed on said pulley 28. Thus, pulley 28 may be first rotated a specific amount needed to create from coil 46 the desired tension, then bolt 72 is attached to prevent the unwinding of pulley 28 beyond one revolution. Alternatively, coil 46 once end 50 is secured, may be wound around axle 42 to generate the required tension and then secured to pulley 28.

The traction force may also be varied by the size of the spring coil 46. For example, a wire of 0.095 inches in diameter will give a pull of approximately 7.5 pounds, while a wire of 0.195 inches in diameter will give a pull of approximately 18 pounds.

It is of course understood that although the preferred embodiment of the present invention has been illustrated and described, various modifications, alternatives and equivalents thereof will become apparent to those skilled in the art and, accordingly, the scope of the present invention should be defined only by the appended claims and equivalents thereof.

What is claimed is:

1. A therapeutic traction device useable with a traction sling comprising:

a. support means;

b. a pulley rotatably attached to said support means; said pulley having a grooved run;

c. a length of cord wound around said pulley; said cord having an end portion extending from said groove of said pulley and connecting to the traction sling;

d. spring means for spring loading said pulley, said spring means including a coil spring having one end which connects to said pulley and another end which is fixed with respect to said support means, said coil spring having laterally extending coils between said one and another ends; and e. means for preventing rotation of said pulley beyond a predetermined angle; said means for preventing rotation of said pulley including a stop formed on said support means and a projecting member attached to said pulley to contact said stop within one revolution of said pulley.

2. The therapeutic traction device of claim 1, wherein said means for affixing said support means comprises a base member rigidly attached to said support means and shaped to rest between a bed frame and mattress.

3. The therapeutic traction device of claim 1, wherein said support means comprises an elongated rod having means for attaching said pulley at one of a plurality of positions on said rod.

4. The therapeutic traction device of claim 1, further comprising means for adjusting the angle of traction pull between said pulley and said traction sling.

5. The therapeutic traction device of claim 1 further comprising means for presetting the spring loading of said pulley.

6. The therapeutic traction device of claim 5, wherein said spring loaded pulley includes spring means having a predetermined loading characteristic; and means for attaching said spring means between said upright support means and said pulley, said means for presetting the spring loading of said pulley including means for preventing the rotation of said pulley beyond a predetermined angle.

7. The therapeutic device of claim 1 which additionally comprises means for affixing said support means with respect to a platform, said affixing means including a base member rigidly attached to said support means and shaped to rest between a bed frame and mattress.

8. The therapeutic device of claim 7 in which said support means comprises an elongated rod and means for attaching said pulley at a plurality of positions on said rod.

9. The therapeutic traction device of claim 8 which further comprises means for presetting the spring loading of said pulley.

10. The therapeutic traction device of claim 9 in which said means for attaching said pulley to said rod includes a U-shaped member attached at one of said plurality of positions on said rod, the two arms of said U-shaped member having an axle hole defined in each arm, an axle positioned between the ends thereof riding in said axle holes, and said coil spring substantially surrounding said axle.

11. A therapeutic traction device comprising:

an upright support member having a plurality of attachment positions defined therealong;

a base member, including means for rigidly attaching said base member to the bottom of said support member, said base member having a shape adapted to extend into and rest between a bed frame and mattress;

a U-shaped member attached at one of said plurality of positions on said support member, the two arms of said U-shaped member extending towards said bed and having an axle hole defined in each said arm;

an axle positioned between said arms of said U-shaped member, the ends thereof riding in said axle holes;

a pulley having a grooved rim and a centrally defined axle hole mounted with said axle extending therethrough, such that said pulley is enabled to rotate on said axle between said arms;

a coil spring, one end of said spring attached to said pulley, the other end of said spring fixed with respect to said U-shaped member;

a length of cord attached to one end of said pulley and wrapped in said groove, the other end of said cord extending from said groove;

means for attaching said other end of said cord to a traction sling; and means for presenting the level of tension of said coil spring, said means including means for preventing the rotation of said pulley beyond a predetermined angle, including a stop formed on said U-shaped member and a projecting member attached to said pulley defined in a position such that said projecting member contacts said stop before one complete revolution of said pulley can occur.

12. The therapeutic traction device of claim 11 wherein said base member is defined in the shape of a triangle, said means for attaching said base member to said support member being located at one corner thereof, said triangle oriented on a plane perpendicular to said upright support member.

13. The therapeutic traction device of claim 11, further comprising means for adjusting the angle of traction pull between said pulley and said traction sling.

14. The therapeutic traction device of claim 11, wherein said coil spring comprises a wire coil of a size to allow said axle to extend therethrough, said coil positioned on said axle between said pulley and one of said arms of said U-shaped member.

* * * * *